United States Patent [19]

Tonks

[11] Patent Number: 4,897,020

[45] Date of Patent: Jan. 30, 1990

[54] NOZZLE GUIDE VANE FOR A GAS TURBINE ENGINE

[75] Inventor: Robert C. Tonks, Bridgwater, England

[73] Assignee: Rolls-Royce plc, London, England

[21] Appl. No.: 349,173

[22] Filed: May 8, 1989

[30] Foreign Application Priority Data

May 17, 1988 [GB] United Kingdom ..... 8811657

[51] Int. Cl.[4] ..... F01D 5/08

[52] U.S. Cl. ..... 415/115; 415/161; 416/96 A

[58] Field of Search ..... 415/115, 116, 114, 160–165; 416/95, 96 R, 96 A, 97 R

[56] References Cited

U.S. PATENT DOCUMENTS

| | | | |
|---|---|---|---|
| 2,476,001 | 7/1949 | Stalker | 415/161 |
| 4,097,187 | 6/1978 | Korta | 415/161 |
| 4,193,738 | 3/1980 | Landis, Jr. et al. | 415/115 |
| 4,314,442 | 2/1982 | Rice | 415/115 |
| 4,565,490 | 1/1986 | Rice | 415/115 |
| 4,705,452 | 11/1987 | Karadimas | 415/115 |

FOREIGN PATENT DOCUMENTS

| | | | |
|---|---|---|---|
| 86599 | 9/1957 | Netherlands | 415/115 |

*Primary Examiner*—Robert E. Garrett
*Assistant Examiner*—John T. Kwon
*Attorney, Agent, or Firm*—Oliff & Berridge

[57] ABSTRACT

A nozzle guidevane for a gase turbine engine 10 comprising a first fixed upstream portion 24, a movable downstream portion 26 and a seal situated therebetween. The seal comprises two pairs of ridges 56, 58 on the upstream portion and two ridges 60 on the downstream portion 26 which co-operate with each other to form a flow restrictor which maintains the flow of escaping air within acceptable limits. The air which does escape is used to advantage by maintaining the mainflow of air over the outside of the vane 22.

8 Claims, 2 Drawing Sheets

NOZZLE GUIDE VANE FOR A GAS TURBINE ENGINE

This invention relates to nozzle guide vanes and particularly to a nozzle guide vane having a movable downstream portion.

Nozzle guidevanes (NGV's) are commonly used in the turbine section of a gas turbine engine, where they act to direct the flow of incoming exhaust gasses onto the rotating turbine blades. More advanced NGV's incorporate a movable downstream portion which pivots about a longitudinally extending axis near its upstream end. The downstream portion acts to vary the angle at which the exhaust gasses leave the NGV in accordance with the operating requirements of the engine.

One major problem associated with the above mentioned design is how to seal the gap between the fixed upstream portion and the movable downstream portion in order to prevent excessive amounts of cooling air escaping from the interior of the vane.

One possible way of overcoming the problem might be to bridge the gap with a contacting seal mounted on one of the two components. Such seals however are prone to rapid wear in the high temperature environment and consequently their sealing efficiency is rapidly reduced below acceptable limits.

A small loss of cooling air in the region of the gap is acceptable if the amount can be predicted, remains constant throughout the life of the vane and can be utilised to achieve another effect.

It is an object of the present invention to provide a sealing device for nozzle guide vanes which complies with the above mentioned requirements.

Figures 1, 2:
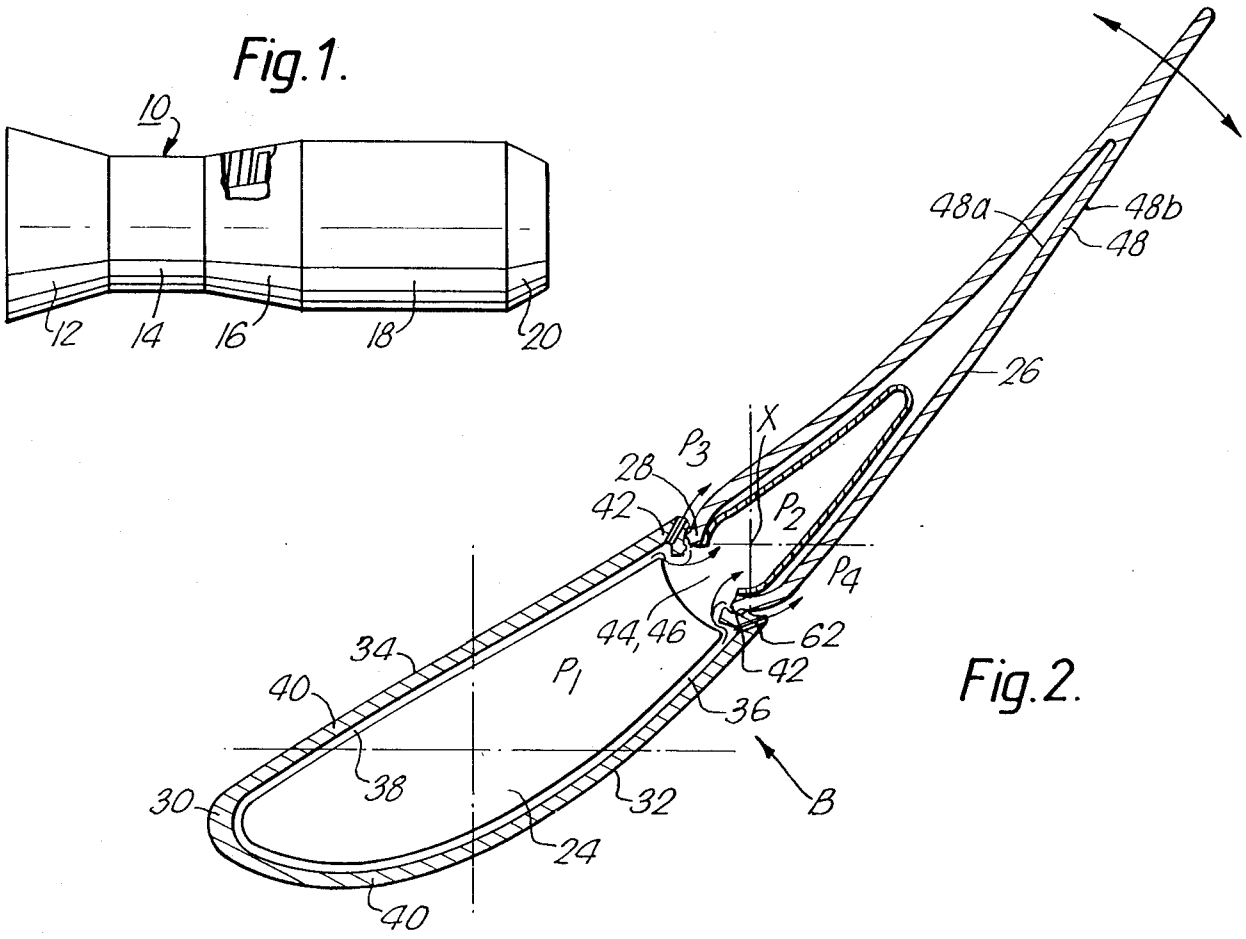
Figure 3:
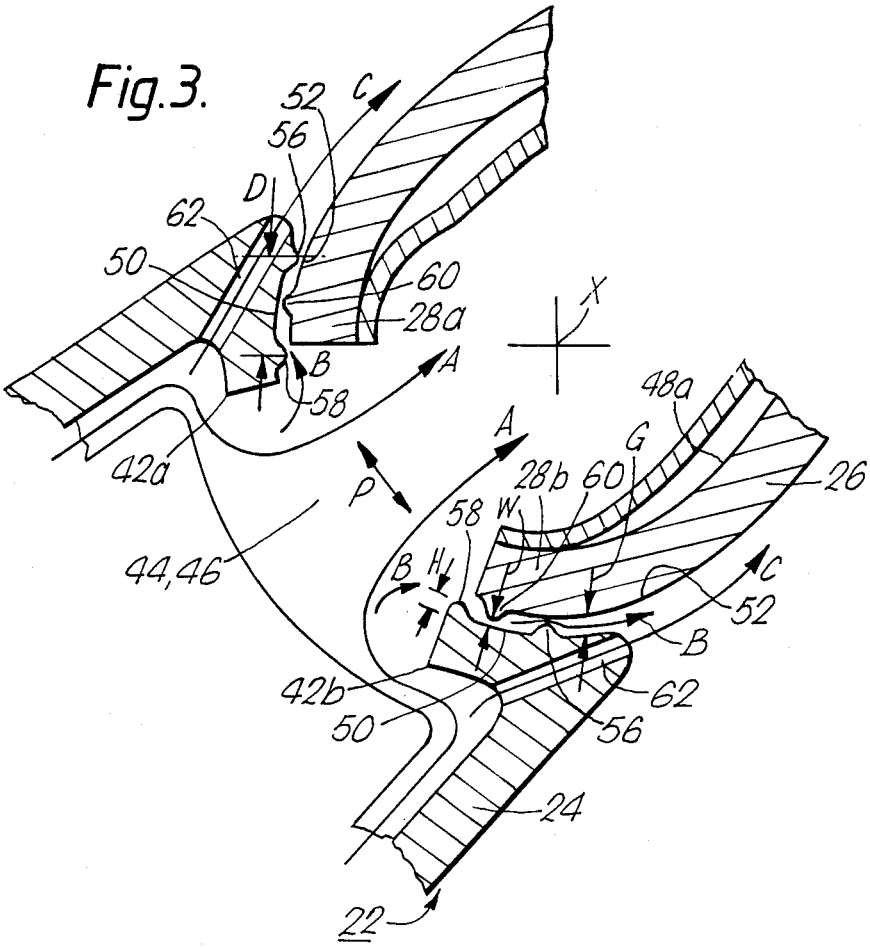
Figure 4:
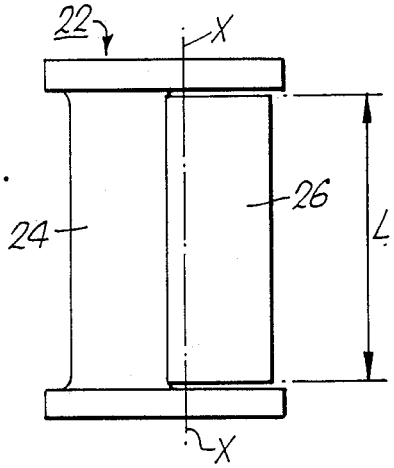

The present invention will now be described by way of example only with reference to the accompanying drawings, in which:

FIG. 1 is a pictorial representation of a gas turbine engine incorporating the present invention, FIG. 2 is a cross sectional view of a nozzle guidevane of the above mentioned engine incorporating the present invention, FIG. 3 is an exploded view of the sealing devices shown in FIG. 2, and FIG. 4 is a diagramatic view of the vane, taken in the direction of arrow B in FIG. 2.

Referring to FIG. 1, a gas turbine engine 10 comprises in flow series an axial flow compressor 12, combustion means 14, turbine means 16 connected to the compressor 12 to drive said compressor, a jetpipe 18 and a rear nozzle 20. Within the turbine means 16 there is provided a variable position nozzle guidevane 22 which acts to direct the flow of exhaust gasses and which is best seen in FIGS. 2 and 3.

In FIG. 2, it can be seen that the nozzle guide vane comprises a first fixed upstream portion 24 and a movable downstream portion 26 which is pivotable about a longitudinally extending axis X positioned near its upstream end 28. The upstream portion 24 is conventional in form having a leading edge 30, a convex side 32 and a concaved side 34 together with a cooling passage 36 which allows cooling air to pass across the inner surface 38 of the skin 40 of said portion 24. The downstream end 42 of the upstream portion 24 is provided with a passageway 44 which splits the downstream end 42 into two halves **42*a* and 42*b* along the entire length of the vane and allows a portion of the cooling air to pass into the downstream portion 26 via an orifice 46 which effectively divides the upstream end 28 of the downstream portion 26 into two halves 28*a*, 28*b*. The cooling air acts to cool the inner surface 48*a* of the skin 48 on the downstream portion 26** in the conventional manner.

Referring now more particularly to FIG. 3, it can be seen that in order to accommodate the movement of the downstream portion 26 it is necessary to space it from the upstream portion 24 by a predetermined amount and profile the confronting surfaces 50, 52 thereof in a suitable manner. The arrangement shown is provided with a concaved surface 50 on the downstream end 42 of the upstream portion 24 and a corresponding convex surface 52 on the upstream end 28 of the downstream portion 26.

It will be appreciated that in order to prevent an excessive amount of air escaping from the interior of the vane 22 it is necessary to provide a seal of some description in the region of the gap G. The seal shown in FIG. 3 comprises a pair of ridges 56, 58 on each half **42*a*, 42*b* of the downstream end 42 of the upstream portion and a single ridge 60 on each half 28*a*, 28*b* of the upstream end 28 of the downstream portion 26. Each ridge 56, 58, 60 extends the entire length L of the portion 24, 26 upon which it is situated. The two ridges 56, 58 of each pair are each spaced from each other by a predetermined amount D and one of the two ridges 60 is positioned between each pair of ridges 56, 58. The height H of each ridge 56, 58, 60 is less than the width of the gap G such that a small passage of width W remains and is selected to accommodate the thermal expansion of the two portions and restrict the flow of cooling air through said gap G. The ridges effectively act as flow restricting devices which reduce the flow of cooling air in the region of the gap G to within acceptable limits. Obviously, the smaller the width of the passage W the less the flow of air will be. Movement of the downstream portion 26 is accommodated by positioning each of the ridges 60 at a suitable position between each of the two ridges 56, 58 which they confront. Movement of the downstream portion 26 then results in the ridges 60 moving between the two adjacent ridges 56, 58 during operation. It will be appreciated that the width of the passage W will remain constant throughout the movement of the downstream portion 26 only if the profile of the confronting surfaces 50, 52** of each portion is matched by for example curving them about radii having a common centre, for example the axis X in FIGS. 3 and 4.

The amount of cooling air escaping through the gap G may be minimised with the above mentioned seal, however, it is accepted that some air will inevitably escape. The escaping air may be used to advantage by for example passing it across the outside surface **48*b* of the downstream portion 26 such that it acts to entrain the mainflow of air over the outside surface of the vane 22** in the region of the boundary layer and hence prevent air separation therefrom.

It may be advantageous to provide additional cooling passages in the region of the downstream end 42 of the upstream portion 24 such as those shown at 62. Cooling air passing through said passages 62 acts to both cool the region and aid the maintenance of the boundary layer of airflow over the vane 22 in a manner already well known and therefore not described herein.

I claim:

1. A nozzle guide vane for a gas turbine engine comprising:

a fixed upstream portion, having an upstream and a downstream end;

a movable downstream portion, having an upstream end and a downstream end said upstream end confronting, and being spaced by a predetermined amount from, the downstream end of the upstream portion;

a passage, provided in the upstream portion for the passage of cooling air therethrough;

a second passageway, provided at the downstream end of the upstream portion for the passage of cooling air therethrough and for directing said cooling air onto the upstream end of the downstream portion;

a third passageway, provided at the upstream end of the downstream portion for receiving cooling air directed thereupon;

a sealing device, situated between the upstream portion and the downstream portion comprising a plurality of ridges situated on the confronting ends of the upstream and downstream portions, said ridges extending towards the other portion to reduce the gap therebetween.

2. A nozzle guide vane according to claim 1 in which the second passage way in the upstream portion and the passage way in the downstream portion extend along substantially the entire length of the vane, and act to divide said confronting ends into two halves.

3. A nozzle guide vane according to claim 1 in which the confronting ends of the upstream and downstream portions are profiled to provide a concaved surface on the upstream portion and a convex surface on the downstream portion.

4. A nozzle guide vane according to claim 1 in which the confronting ends of the upstream and downstream portions are profiled to provide a concaved surface on the upstream portion and a convex surface on the downstream portion and the concaved and convex surfaces are curved about a common axis.

5. A nozzle guide vane according to claim 1 in which the downstream portion is provided with a longitudinally extending axis positioned near its upstream end about which said downstream portion pivots.

6. A nozzle guide vane according to claim 1 in which the downstream portion is provided with a longitudinally extending axis positioned near its upstream end about which said downstream portion pivots and in which the centre of curvature of the convexed and concaved surfaces is said longitudinally extending axis.

7. A nozzle guide vane according to claim 1 in which the second passage way in the upstream portion and the passage way in the downstream portion extend along substantially the entire length of the vane, and act to divide said confronting surfaces into two halves and in which a pair of ridges are provided on each half of the confronting end of the upstream portion and one ridge is provided on each half of the confronting end of the downstream portion.

8. A nozzle guide vane according to claim 1 in which the second passage way in the upstream portion and the passage way in the downstream portion extend along substantially the entire length of the vane, and act to divide said confronting surfaces into two halves a pair of ridges being provided on each half of the confronting end of the upstream portion and one ridge being provided on each half of the confronting end of the downstream portion the ridges of each pair being spaced from each other by a predetermined amount and a ridge on the confronting end of the downstream portion being positioned between the ridges of each pair.

* * * * *